US006392336B1

(12) United States Patent
Sugawara et al.

(10) Patent No.: US 6,392,336 B1
(45) Date of Patent: May 21, 2002

(54) GLASS FUNNEL FOR A CATHODE RAY TUBE AND CATHODE RAY TUBE

(75) Inventors: Tsunehiko Sugawara; Kentaro Tatsukoshi, both of Chiba (JP)

(73) Assignee: Asahi Glass Company Ltd., Tokyo (JP)

( * ) Notice: Subject to any disclaimer, the term of this patent is extended or adjusted under 35 U.S.C. 154(b) by 0 days.

(21) Appl. No.: 09/401,262

(22) Filed: Sep. 23, 1999

(30) Foreign Application Priority Data

Oct. 6, 1998 (JP) ..... 10-284462

(51) Int. Cl.[7] ..... H01J 29/86
(52) U.S. Cl. ..... 313/477 R; 220/2.1 A
(58) Field of Search ..... 313/477 R, 478, 313/477 NC, 479; 445/8, 22–24, 45; 348/823, 805, 808, 821; 220/2.1 A, 2.3 A, 2.3 R

(56) References Cited

U.S. PATENT DOCUMENTS 2,969,162 A * 1/1961 Stutske ..... 220/2.1 A
3,720,345 A * 3/1973 Longe ..... 220/2.1 A
4,029,898 A * 6/1977 Belentepe et al. ..... 358/247
4,030,627 A * 6/1977 Lentz ..... 220/2.1 A
4,686,415 A * 8/1987 Strauss ..... 313/402
5,240,447 A * 8/1993 Capek et al. ..... 445/45
5,258,688 A * 11/1993 Fondrk ..... 313/477 R
5,925,977 A * 7/1999 Sugawara et al. ..... 313/477 R
5,929,559 A * 7/1999 Sano et al. ..... 313/477 R
6,018,217 A * 1/2000 Fondrk ..... 313/477 R

FOREIGN PATENT DOCUMENTS

EP 0-369-77 * 5/1990
EP 0 369 770 5/1990

* cited by examiner

*Primary Examiner*—Michael H. Day
*Assistant Examiner*—Joseph Williams
(74) *Attorney, Agent, or Firm*—Oblon, Spivak, McClelland, Maier & Neustadt, P.C.

(57) ABSTRACT

Stress concentration that causes at a central portion of side surfaces of a glass funnel body portion close to a sealed portion is restrained by providing concaves in diagonal portions of the glass funnel body portion, which have the highest rigidity.

5 Claims, 3 Drawing Sheets

GLASS FUNNEL FOR A CATHODE RAY TUBE AND CATHODE RAY TUBE

BACKGROUND OF THE INVENTION

1. Field of the Invention

The present invention relates to a glass funnel for a cathode ray tube used mainly for receiving television broadcasting or for other purposes and, a cathode ray tube with the glass funnel employed therein.

2. Discussion of Background

As shown in FIG. 5, a cathode ray tube 1 to be used for receiving television broadcasting or for other purposes mainly comprises a substantially box-like panel portion 3 having a rectangular face for displaying images, and a funnel portion (glass funnel) 2. The panel portion 3 and the glass funnel (hereinbelow, referred to both portions as the glass bulb) are sealed together at a sealing portion 7 made of a solder glass or the like. The funnel portion has an open end portion formed in a substantially rectangular shape to be sealed with the panel portion. The funnel portion 2 comprises a yoke portion 4 for mounting a deflecting yoke coil, a neck portion 5 for housing a set of electron guns 17, and a body portion 6 connecting the yoke portion and the open end portion.

In FIG. 5, reference numeral 8 designates a panel skirt portion, reference numeral 9 designates a panel face portion for displaying images, reference numeral 10 designates an anti-implosion reinforcing band for providing required strength, reference numeral 12 designates a phosphor layer for emitting fluorescence by irradiating electron beams, reference numeral 13 designates an aluminum layer for reflecting the emission at the phosphor layer forwardly, reference numeral 14 designates a shadow mask, and reference numeral 15 designates stud pins for fixing the shadow mask 14 to an inner surface of the panel skirt portion 8. A symbol A designates a tube axis passing the central axis of the neck portion 5 and the center of the panel portion 3. The screen provided by the phosphor layer formed on an inner surface of the panel portion is formed in a substantially rectangular shape so as to be defined by four sides in substantially parallel with a long axis and a short axis perpendicular to the tube axis.

In the cathode ray tube employing the substantially box-like panel portion and the glass funnel, a differential pressure of 1 atmospheric pressure between the inside of the cathode ray tube and the outside of the cathode ray tube is applied to regions with great tensile stress (indicated by a "+" sign) and regions with compressive stress (indicated by a "−" sign) in a relatively wide range at edges of the panel face on the long and short axes and on outer surfaces of the panel portion and the glass funnel close to the sealing portion as shown in FIG. 6 since the cathode ray tube is formed in an asymmetric shape, not in a spherical shape. In FIG. 6, a stress distribution is shown wherein a dotted line represents stress applied in a direction along the sheet and a solid line represents stress applied in a direction perpendicular to the sheet. The numbers affixed along the stress distribution represent stress values (unit: $kg/cm^2$) at respective spots.

As clearly seen from FIG. 6, the glass bulb has such a two-dimensional stress distribution formed thereon, and the tensile stress induced by vacuum (hereinafter vacuum stress) reaches a maximum on edges of an image displaying surface of the panel face portion on the long or short axes, or locations close to the sealing portion. If the tensile stress is great, and if a glass bulb does not have sufficient structural strength, the glass bulb is subjected to static fatigue failure by the atmospheric pressure to prevent the cathode ray tube from functioning.

In the manufacturing process for cathode ray tubes, thermal stress is caused in the cathode ray tubes in particular when evacuation is carried out with a high temperature of about 380° C. maintained. If the thermal stress is added to the vacuum stress caused by the evacuation, there is a possibility that violent implosion is brought about by instantaneous entry of air and the reaction thereto to cause damage to surroundings at the worst.

In order to ensure that a glass bulb is prevented from imploding, an external pressure applying test is carried out by applying a pressure to the glass bulb, which has been uniformly abraded with an emery sheet of #150 in consideration of the magnitude of damages caused in a glass surface in the assembling process of the glass bulb and the cathode ray tube, the practical service life of the cathode ray tube and other factors. The test is conducted to find a differential pressure between the internal pressure in the glass bulb and the external pressure outside the glass bulb that is caused when the fracture of glass bulb has occurred. The glass bulb is manufactured so as to normally withstand even if the differential pressure is not less than 3 atmospheric pressures.

In consideration of the fatigue failure caused by stress due to the vacuum stress, there is a high possibility that the implosion occurs, having a starting point in a region where the maximum value, $\sigma Vmax$, of the tensile vacuum stress exists. In other words, it is preferable to restrain $\sigma Vmax$ as small as possible since the structural strength to failure of a glass bulb depends on the two-dimensional tensile vacuum stress originated in the shape of the glass bulb and existing on the outer surface of the glass bulb.

However, the wall thickness and the shape of the glass bulb have been normally determined to have $\sigma Vmax$ in the range of 6 MPa–9 MPa in consideration of the restraint of the wall thickness of the glass bulb in a reasonable range and the service life required for the cathode ray tube. The wall thickness and the shape of the panel skirt portion, the body portion of the glass funnel and the sealing portion are designed so as to restrain $\sigma Vmax$ to about 7 MPa at the maximum since the sealing portion with solder glass used has low strength.

When designing of the conventional glass bulb is made, the body portion 6 of the glass funnel has had a shape thereof smoothly changed so that contour lines 16 around the tube axis A with respect to the open end portion 17 of the glass funnel portion are depicted in a rectangular shape similar to the substantially rectangular open end portion at locations close to the sealing portion with the panel portion and in a shape similar to the circular cone or the pyramidal cone of the yoke portion 4 at locations close to the yoke portion as shown in FIG. 4. Thus, the contour lines have had an outwardly convex curvature on the entire area of the body portion.

In order to cope with enlargement of cathode ray tubes in recent years, the panel face portions have a radius of curvature thereof increased to be flattened so as to ensure the viewability of the screen. In order to restrain the volume of large-sized cathode ray tubes, the deflecting angle of electron beams is expanded to shorten the glass bulb. Making the panel portion flattened and making the glass funnel shortened increase the maximum tensile vacuum stress. In addition to an increase in the maximum tensile vacuum stress, the location where the maximum tensile vacuum stress is occurred at the body portion of the glass funnel approaches a location closer to the sealing portion, which causes stress concentration at the location close to the sealing portion to further increase the maximum tensile vacuum stress.

Further, making the panel portion flattened not only causes the stress concentration on the panel portion but also promotes the stress concentration on the glass funnel since the panel portion and the glass funnel are sealed. For the same reason, making the glass funnel shortened not only causes stress concentration at the locations close to the sealing portion of the body portion with the panel portion, in particular, the respective sides of the substantially rectangular shaped opening end portion, in more particular, at a central portion of each of the respective sides, but also increases the vacuum stress that causes at a central portion of the respective sides of the panel. In order to cope with this problem, the conventional glass bulb has had the wall thickness significantly increased to reduce the stress, ensuring the required strength at the sealing portion and the locations close thereto. Making the panel portion flattened and making the glass funnel shortened can restrain the volume of the cathode ray tube and improve the viewability, but on the other hand, they create a problem in that the glass bulb becomes heavier.

SUMMARY OF THE INVENTION

It is an object of the present invention to eliminate the problems in the conventional techniques that making the panel portion flattened and making the glass funnel shortened increase the maximum tensile vacuum stress at the locations close to the sealing portion and cause the glass bulb to become heavier, and to provide a light-weight glass funnel.

The present invention is proposed to solve the above-mentioned problems. The present invention improves the shape of the glass funnel body portion to disperse the maximum tensile vacuum stress caused on the glass funnel and eliminate the stress concentration, reducing the maximum tensile vacuum stress and making the glass funnel stronger and lighter.

The present invention provides a glass funnel for a cathode ray tube and a cathode ray tube with the glass funnel employed therein, wherein the glass funnel includes a substantially rectangular-shaped open end portion to be sealed with a panel portion, and comprises a neck portion for housing a set of electron guns, a yoke portion for mounting a deflecting yoke coil, and a body portion extending between the open end portion and the yoke portion, and wherein the body portion is formed in a funnel-like shape to merge from the open end portion into the yoke portion, and the body portion has concaves formed in diagonal portions thereof in diagonal line directions thereof.

BRIEF DESCRIPTION OF THE DRAWINGS

A more complete appreciation of the invention and any of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The glass funnel according to the present invention is a hollow glass structure that includes a substantially rectangular-shaped open end portion to be sealed with a panel portion, and comprises a yoke portion for mounting a deflecting yoke coil, a neck portion for housing a set of electron guns, and a body portion connecting between the yoke portion and the open end portion as stated earlier. The body portion is formed in a funnel-like shape as a whole to merge from the rectangular open end portion into the yoke portion at the inner and outer sides thereof. The glass funnel maintains this basic structure though the shape or the profile of the funnel-like shape varies according to the degree of shortening of the glass funnel, the aspect ratio of the opening end portion or another factor.

Figure 2:
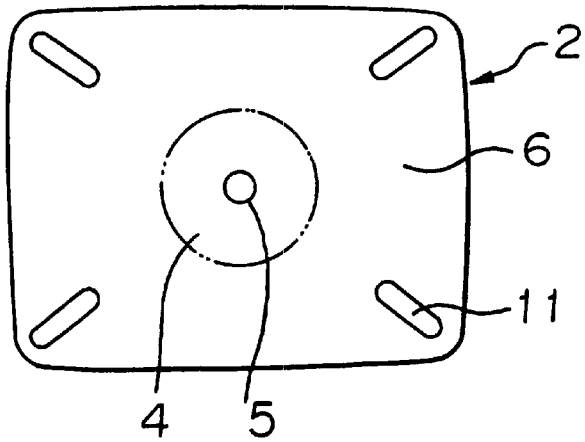
FIG. 2 is a plan view of the example as viewed from the side of the neck portion.

One of the features of the present invention is that the body portion has concaves formed in diagonal portions thereof in certain fashion. In FIG. 2 is shown a plan view of the glass funnel wherein the body portion 6 has concaves 11 formed in diagonal portions thereof, as viewed from the side of the neck portion. As shown in this Figure, the concaves 11 are provided at the diagonal portions of the body portion 6 in diagonal line directions thereof. The reason why the concaves 11 are provided at the diagonal portions of the body portion 6 is that the diagonal portions, which are supported by adjacent two surfaces and have the highest rigidity in the body portion, have the rigidity thereof reduced by the provision of the concaves 11. The reason why the concaves 11 are provided in the diagonal line directions is that the rigidity of the diagonal portions can be effectively reduced in terms of the shape and the structure of the glass funnel. The concaves 11 may not be necessarily provided in the diagonal line directions in the strict sense. It is sufficient that the concaves 11 are provided in substantially diagonal line directions in order to reduce the highest rigidity. The meaning of the provisions of the concaves in the diagonal line directions should be construed in this sense.

The concaves 11 are provided at at least a portion of each of the diagonal portions of the body portion 6. It is effective that the concaves are provided at locations close to a sealing portion of the diagonal portions of the body 6, i.e., at regions close to the opening end portion. The reason is that the maximum vacuum stress, which intensively occurs at a central portion of each of side surfaces of the body portion and has a tensile property, can be effectively reduced by providing the concaves at these regions. The size (length and width) and the depth of the concaves 11 may be adequately determined according to the size of the glass funnel, the glass thickness of the body portion, the shape of the glass funnel including the aspect ratio of the opening end portion, or another factor. The width and the depth of the concaves 11 may be changed along the diagonal line directions. Usually, the width and the depth of the concaves 11 are determined so as to gradually decrease from the open end portion towards the yoke portion, causing the concaves to smoothly merge into curved surfaces of the remaining regions of the body portion.

Although the body portion except for the diagonal portions is normally conventional, a slight modification may be made so as to match with the concaves if necessary. For example, the body portion may have regions at a central portion of each of the side surfaces closer to the open end portion outwardly bulb to increase the degree of curvature in some kinds of glass funnels. The body portion 6 has the inner and outer sides formed in a substantially similar shape.

Figure 3:
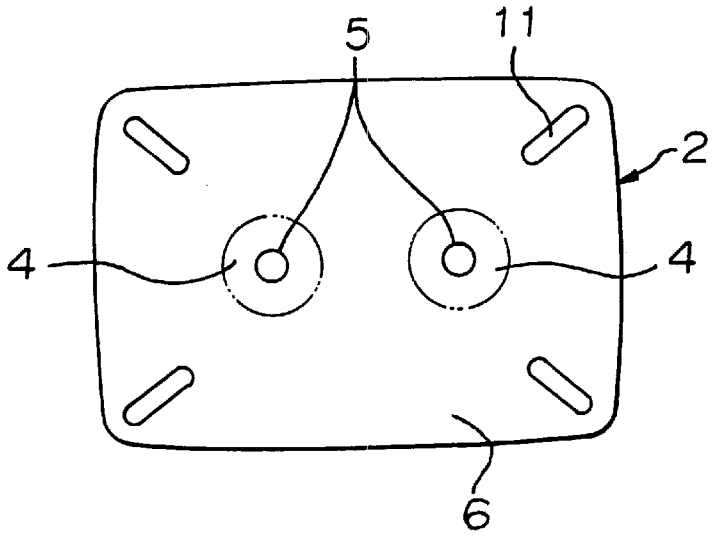
FIG. 3 is a plan view of another example of the glass funnel according to the present invention as viewed from the side of the neck portion.

The present invention may apply to a glass funnel shown in FIG. 3, which has a body portion 6 provided with a plurality of yoke portions 4 and neck portions 5. This type of glass funnel is used in a cathode ray tube that can use plural sets of electron guns and the corresponding sets of deflecting yoke coils to scan electron beams in respective regions obtained by dividing a screen into the corresponding number of sections. This glass funnel offers an advantage in that the glass funnel can be substantially shortened in relative comparison with the width thereof without expanding the deflecting angles of the electron beams. The concaves 11 are normally provided at at least four corners or edges of the body portion 6.

Figure 1:
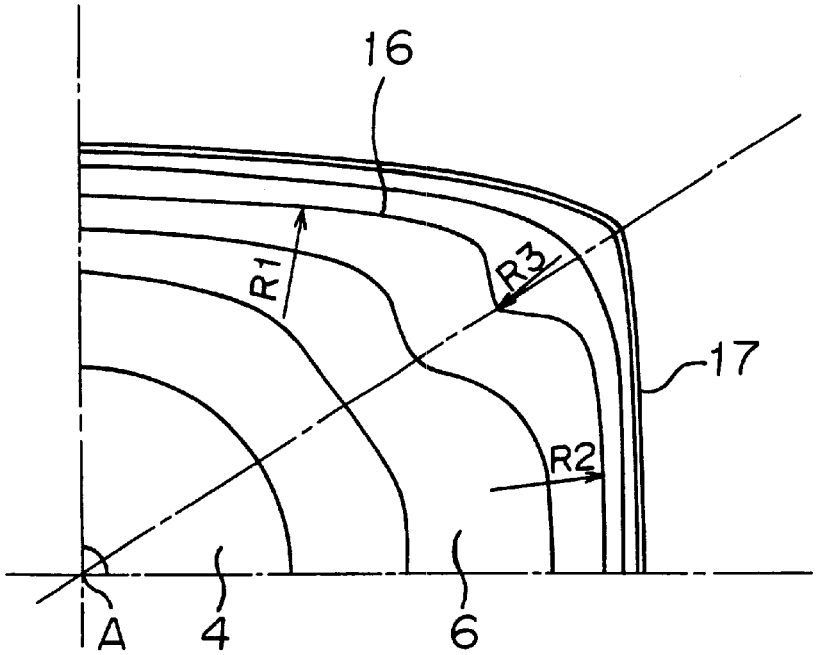
FIG. 1 is a plan view of a quarter portion of an example of the glass funnel according to the present invention with contour lines added, as viewed from the side of a neck portion.

When the concaves 11 according to the present invention are indicated by contour lines on the glass funnel body portion, the concaves are shown as indicated in FIG. 1. In FIG. 1, reference numeral 16 designates the contour lines with respect to an open end portion 17 of the body portion 6. In FIG. 1 are shown the four contour lines as representative heights on the outer side of the body portion 6. References R1, R2 and R3 designate approximate circles forming the contour lines. The reason why R3 is directed to a direction opposite to R1 and R2 is that the circle represented by R3 has central coordinates located outside, which means that the contour line has an inwardly convex curvature. R2 and R3 indicate that the respective circles have central coordinates located inside, which means that the respective contour lines have an outwardly convex curvature.

Compared to the contour lines on the conventional glass funnel body portion (see FIG. 4), the contour lines on the outer side of the glass funnel body portion 6 according to the present invention have the substantially the same shape as those on the conventional body portion in the region closest to the open end portion 17 and at the central portion of each of the side surfaces. On the other hand, the three contour lines in a region closer to the yoke portion includes two lines having inwardly convex curvatures and the remaining one line having a linear shape with an indefinite curvature at the diagonal portions. The contour lines show that the diagonal portions of the body portion 6 are concaved with respect to the remaining regions of the body portion. The depth and the width of the concaves are indicated by the magnitude of the radius of R3. Comparisons with adjoining contour lines reveal that the concaves change along the diagonal line directions so as to have the depth thereof decreased toward the yoke portion 4.

Figure 4:
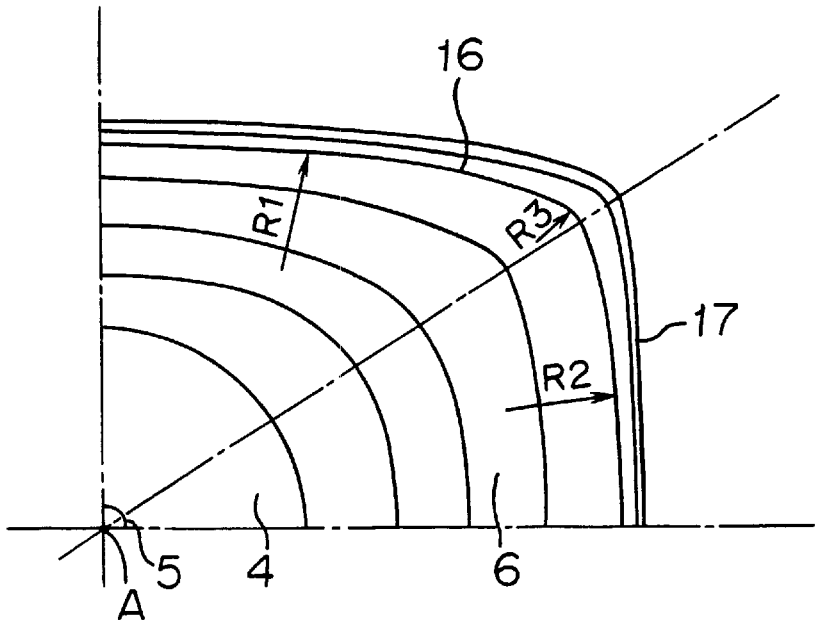
FIG. 4 PRIOR ART
FIG. 4 is a plan view of a quarter portion of a conventional glass funnel with contour lines added, as viewed from the side of the neck portion.

As shown in FIG. 4, the conventional glass funnel body portion has been shaped so that the profiles of the contour lines around the tube axis A with respect to the open end portion merge from a substantially rectangular shape similar to the open end portion to be sealed with the panel portion at locations close to the sealing portion to a shape similar to the circular cone or the pyramidal cone of the yoke portion at locations close to the yoke portion. As a result, the vacuum stress applied to the conventional cathode ray tube, which causes on the diagonal line directions, is a quite small value since the diagonal portions of the glass funnel body portion are supported by the two adjacent side surfaces to have the greatest rigidity. On the contrary, the conventional cathode ray tube is subjected to the greatest tensile vacuum stress on the long and short axes, i.e., central portions of the respective four side surfaces close to the sealing portion.

In accordance with the present invention, the glass funnel body portion has the concaves formed at the diagonal portions thereof in at least regions close to the open end portion as shown in FIG. 1. In other words, if this structure is shown by the contour lines around the tube axis A with respect to the open end portion, the structure has the diagonal portions or corner portions smoothly concaved so as to have the contour lines with an inwardly convex curvature assembled. Although the contour lines are shown to be depicted on the outer side of the body portions in this Figure for convenience, the body portion is formed so as to have the regions in the diagonal portions concaved at the inner side of the body portion since the inner side is substantially similar to the outer side as stated earlier. The concaves work to give a relatively flexible structure to the diagonal portions of the glass funnel body portion having the greatest rigidity, and offer an advantage in that the maximum tensile vacuum stress, which is caused in the central portions of the four side surfaces close to the sealing portion with panel portion, is dispersed and decreased.

EXAMPLE 1

Figure 5:
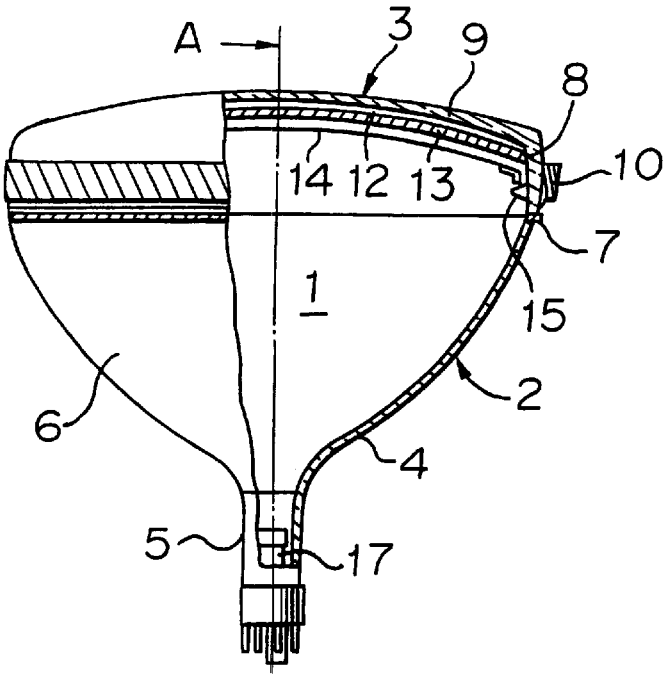
FIG. 5 PRIOR ART
FIG. 5 is a side view of the conventional cathode ray tube with a portion thereof cut away.
Figure 6:
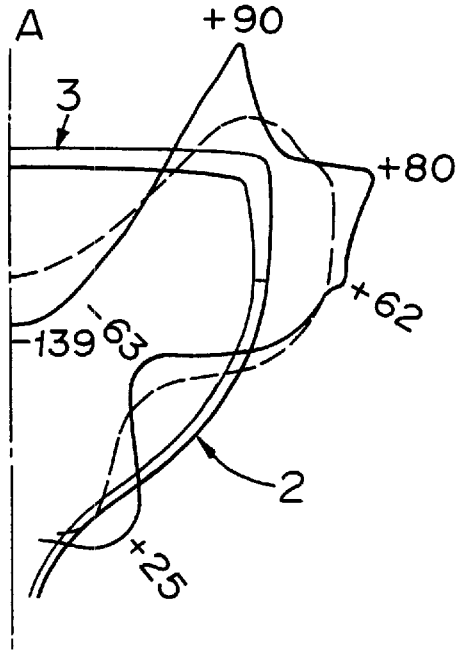
FIG. 6 PRIOR ART
FIG. 6 is a schematic view to show vacuum stress distribution, which is generated on the glass bulb of the cathode ray tube along the long axis thereof.

In this Example, the glass bulb, which could be used for a cathode ray tube for a color television as shown in FIG. 5, was prepared by using glass materials having characteristics shown in Table 3. In the glass bulb, the panel portion had a central face area formed so as to have a wall thickness of 21.0 mm, and the panel portion had an entire height of 80 mm and an aspect ratio of 16:9. The panel portion was usable for a 36 inch of television with a flat effective screen having a diagonal size of 86 cm, and was formed in the same shape as Comparative Example 1. The glass funnel was usable for a 36 inch of television as in the panel portion. The glass funnel includes a circular cone shaped yoke portion, which has a deflecting angle of 130°. The neck portion had an outer diameter of 29.1 mm. The glass funnel had a length of 120.5 mm from the center of deflection to the open end portion thereof.

Table 1 lists the weight of the glass bulbs, the magnitude of the radius of each approximate circle R1, R2 and R3 providing a contour line on the outer side of the glass funnels at the representative heights shown in FIGS. 1 and 4, and other figures. The "−" sign for R3 means that the circle has the central coordinates located outside, i.e., that the circle has an inwardly convex curvature. The "+" sign means that the circle has an outwardly convex curvature.

The glass funnel of the Example 1 was different from the conventional glass funnel of the Comparative Example 1 only in terms of the profile of contour lines on the outer side and the profile of contour lines on the inner side similar thereto. In the Example 1, R3 was outwardly convex in the section between the open end portion and the location having a height of 32 mm with respect to the open end portion. For example, the location having a height of 20 mm with respect to the open end portion had a value of R3=36.5 mm. On the other hand, R3 was inwardly convex from the location having a height of 32 mm with respect to the open end portion to the location having a height of 85 mm with respect to the open end portion. The location having a height of 70 mm had an alternate value of R3=−36.2 mm. R3 was continuously and smoothly changed in the section. R3 was continuously and smoothly changed so as to become outwardly convex from the location having a height of 85 mm with respect to the open end portion to a truly round end of the yoke portion having a height of 90.5 mm with respect to the open end portion, thus providing the outer side of the glass funnel body portion.

The panel portion and the glass funnel were sealed together, the inside of the glass bulb was evacuated, and the maximum vacuum stress thus caused on the glass bulb, more precisely the maximum tensile vacuum stress, was measured. The measurement was carried out about the maximum vacuum stress at essential portions of the glass bulb on the long and short axes and the diagonal axes of the panel portion and the glass funnel. The results are shown in Table 2 (unit: MPa).

In the case of the glass bulb of the Comparative Example 1, great vacuum stress was generated at locations close to the sealing portion since the deflecting angle was wide. In the case of the Example 1, the sealing portion had the vacuum stress reduced from 13 MPa to 6 MPa on the short axis and from 9 MPa to 6 MPa on the long axis as shown in Table 2, compared to the Comparative Example 1. Likewise, the funnel body portion had the vacuum stress reduced from 14 MPa to 9 MPa on the short axis and from 12 MPa to 6 MPa on the long axis. On the other hand, the sealing portion and the funnel body portion had sections thereof in the diagonal line directions subjected to compression stress, and the compression stress was slightly reduced without any practical problem being introduced.

EXAMPLE 2

Although the panel portion and the glass funnel had the same outer shape as those of the Example 1, the thickness of the sealing portion in the entire periphery was reduced from 15 mm to 14 mm by 1 mm, compared to the Example 1. The skirt portion of the panel portion and the entire body portion of the glass funnel had the wall thickness reduced by substantially 2 mm in order to be adjusted to the reduced wall thickness of the seal portion.

Compared to the Example 1, the tensile vacuum stress on the sealing portion increased from 6 MPa to 7 MPa on both long and short axes. However, both values are in a practically acceptable range, compared to the Comparative Example 1. The weight of the glass bulb was reduced from 55.1 kg to 54.3 kg by making the glass bulb thus thinner.

TABLE 1

| Item | | Comparative Example 1 | Example 1 | Example 2 |
|---|---|---|---|---|
| Weight of glass bulb (kg) | | 55.1 | 59.2 | 54.3 |
| Weight of panel portion (kg) | | 36.9 | 36.9 | 36.2 |
| Weight of glass funnel (kg) | | 18.2 | 22.3 | 18.1 |
| Contour line having height of 20 mm with respect to open end portion | R1 (mm) | +4650 | +6670 | +6670 |
| | R2 (mm) | +2530 | +3930 | +3930 |
| | R3 (mm) | +35.9 | +36.5 | +36.5 |
| Contour line having height of 70 mm with respect to open end portion | R1 (mm) | +860 | +6200 | +6200 |
| | R2 (mm) | +3800 | +3500 | +3500 |
| | R3 (mm) | +33.1 | −36.2 | −36.2 |
| Wall thickness of sealing portion (mm) | | 15.0 | 15.0 | 14.0 |
| Wall thickness of location having 100 mm with respect to funnel sealing open end portion on short axis (mm) | | 15.0 | 15.0 | 13.0 |
| Wall thickness of location having 100 mm with respect to funnel sealing open end portion on long axis (mm) | | 15.0 | 15.0 | 13.0 |

TABLE 2

| Item | | Comparative Example 1 | Example 1 | Example 2 |
|---|---|---|---|---|
| Short axis | Panel face edge | 10 | 10 | 10 |
| | Panel skirt portion | 11 | 8 | 9 |
| | Sealing portion | 13 | 6 | 7 |
| | Funnel body portion | 14 | 9 | 10 |
| Long axis | Panel face edge | 8 | 8 | 8 |
| | Panel skirt portion | 8 | 7 | 8 |
| | Sealing portion | 9 | 6 | 7 |
| | Funnel body portion | 12 | 6 | 6 |
| Diagonal line directions | Panel face edge | 4 | 4 | 4 |
| | Panel skirt portion | 1 | 1 | 1 |
| | Sealing portion | −2 | −1 | −1 |
| | Funnel body portion | −3 | −3 | −3 |

TABLE 3

| | Panel portion | Funnel portion | Neck portion |
|---|---|---|---|
| Name (product name) | 5008 | 0138 | 0150 |
| Density (g/cm$^3$) | 2.79 | 3.00 | 3.29 |
| Young's modulus (kg/cm$^2$) | $7.5 \times 10^5$ | $6.9 \times 10^5$ | $6.2 \times 10^5$ |
| Poisson's ratio | 0.21 | 0.21 | 0.23 |
| Softening point (° C.) | 703 | 663 | 643 |
| Annealing point (° C.) | 521 | 491 | 466 |
| Straining point (° C.) | 477 | 453 | 428 |

In accordance with the present invention, the curved surfaces of the glass funnel body portion, in particular the diagonal sections of the body portion are formed in a specific shape, i.e., have the concaves formed in the diagonal directions. By the provision of the concaves, the peak tensile vacuum stress that is caused at central portions of the four side surfaces close to the sealing portion and has a relatively great value can be dispersed and be significantly reduced, offering an effect to make the distribution of the vacuum stress balanced, though the vacuum stress that is caused at locations on the outer side of the diagonal portions close to the sealing portion and has a relatively small value is slightly decreased. This effect can reduce the wall thickness of at least sections of the body portion close to the sealing portion and the panel skirt portion thinner so as to make the glass bulb lighter. This effect becomes more significant as the deflecting angle is widened to make the glass panel flattened.

The present invention is also applicable to a glass funnel for a cathode ray tube that includes plural sets of electron guns and a deflecting yoke coil corresponding thereto in a single glass funnel body portion, and that the respective sets of electron guns and a deflecting yoke coil scan electron beams in divided regions. In this case, the present invention can offer a significant effect.

The sealing portion can be made thinner to reduce a temperature difference between the outer and inner sides thereof so as to restrain the thermal stress that is caused in the thermal treatment during assembling of a cathode ray tube. Thus, the present invention can easily produce a cathode ray tube that is enough strong to avoid breakage of the glass bulb.

Obviously, numerous modifications and variations of the present invention are possible in light of the above teachings. It is therefore to be understood that within the scope of the appended claims, the invention may be practiced otherwise than as specifically described herein.

What is claimed is:

1. A glass funnel for a cathode ray tube including a substantially rectangular-shaped open end portion to be sealed with a panel portion, and comprising a neck portion for housing a set of electron guns, a yoke portion for mounting a deflection yoke coil, and a body portion extending between the open end portion and the yoke portion, wherein the body portion is formed in a funnel-like shape to merge from the open end portion into the yoke portion, and the body portion has an outer side thereof provided with contour lines with respect to the open end portion as viewed along the axis of the funnel-like shape, wherein the contour lines have an outwardly convex curvature at a central portion of each side surface of the body portion and the contour lines have an inwardly convex curvature at each of diagonal portions of the body portion.

2. The glass funnel according to claim 1, wherein the concaves are provided at a predetermined spacing from the open end portion.

3. The glass funnel according to claim 1, wherein the body portion has the outer side and an inner side formed in a substantially identical or similar shape.

4. The glass funnel according to claim 1, wherein the contour lines have respective radiuses of curvature in the diagonal portions decreased from the open end portion toward the yoke portion.

5. The glass funnel according to claim 1, wherein the body portion has two or more sets of neck portions and yoke portions.

* * * * *